US005108572A

United States Patent [19]

Lathion

[11] Patent Number: 5,108,572

[45] Date of Patent: Apr. 28, 1992

[54] ELECTROLYTIC FURNACE

[75] Inventor: Jean Lathion, St-Leonard, Switzerland

[73] Assignee: Yan Lathion, Switzerland

[21] Appl. No.: 347,941

[22] PCT Filed: Jul. 28, 1988

[86] PCT No.: PCT/CH88/00131

§ 371 Date: May 19, 1989

§ 102(e) Date: May 19, 1989

[87] PCT Pub. No.: WO89/01061

PCT Pub. Date: Feb. 9, 1989

[30] Foreign Application Priority Data

Jul. 29, 1987 [CH] Switzerland ..... 2889/87

[51] Int. Cl.[5] ..... C25C 3/00

[52] U.S. Cl. ..... 204/243 R; 204/286

[58] Field of Search ..... 204/243 R, 67, 291

[56] References Cited

U.S. PATENT DOCUMENTS 2,861,036 11/1958 Simon-Suisse ..... 204/243
3,764,509 2/1972 Etzel ..... 204/243 R
4,259,161 3/1981 Das ..... 204/243 R
4,421,625 12/1983 Fischer ..... 204/243 R
4,544,469 10/1985 Boxall ..... 204/243 R

FOREIGN PATENT DOCUMENTS 3120579 5/1982 Fed. Rep. of Germany .
173011 5/1965 U.S.S.R. .
1236000 6/1986 U.S.S.R. .

*Primary Examiner*—John Niebling
*Assistant Examiner*—Caroline Koestner
*Attorney, Agent, or Firm*—Woodard, Emhardt, Naughton, Moriarty & McNett

[57] ABSTRACT

An electrolytic furnace comprises refractory concrete elements (1) which are loosely mounted on rails (6) arranged in a tank (6) and which support carbon elements (2) and metal bars (3). The refractory concrete elements (1) on the one hand and the carbon elements (2) and the metal bars on the other are assembled by the action of compression springs (7 and 8) which press against floating plates (12) held laterally by adjustable screws (10) mounted at the threaded ends of rods (9).

3 Claims, 4 Drawing Sheets

Fig. 1 A-A
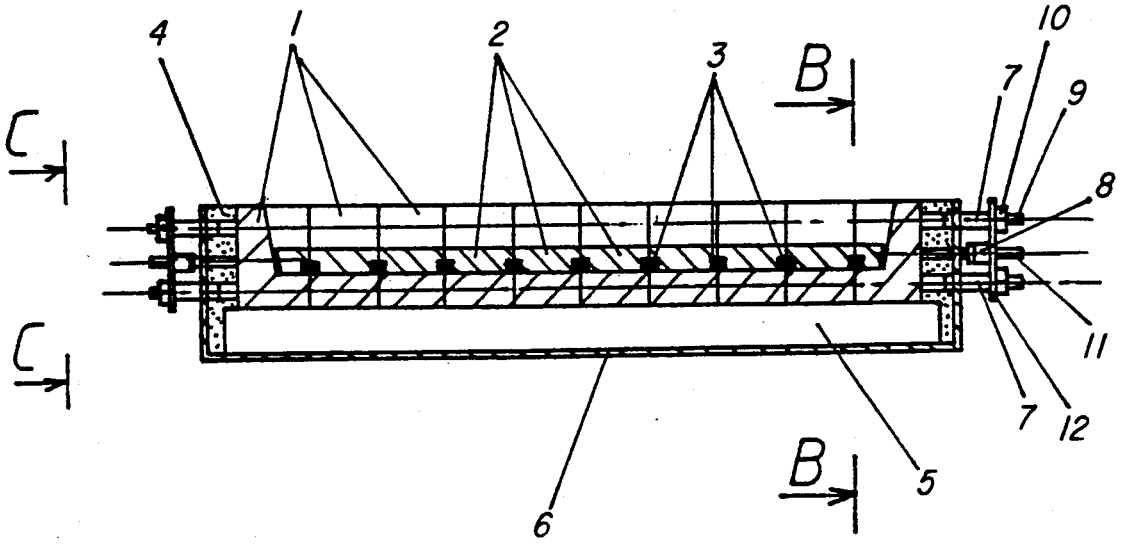
Fig. 2 B-B
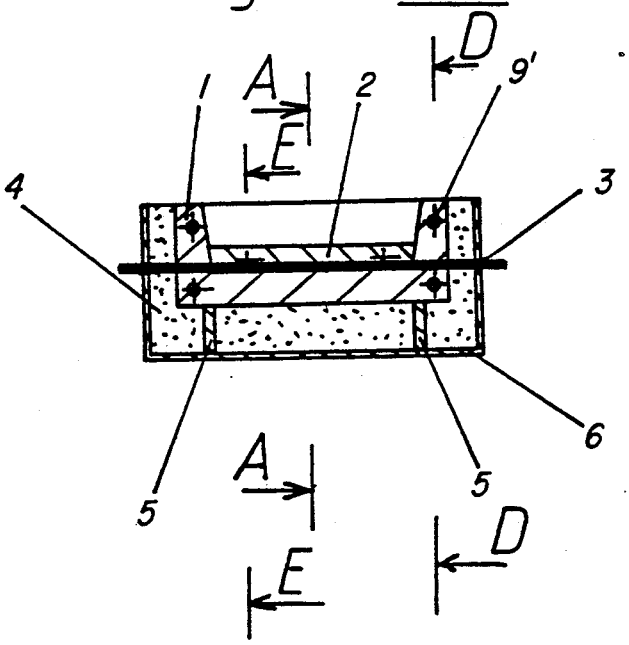

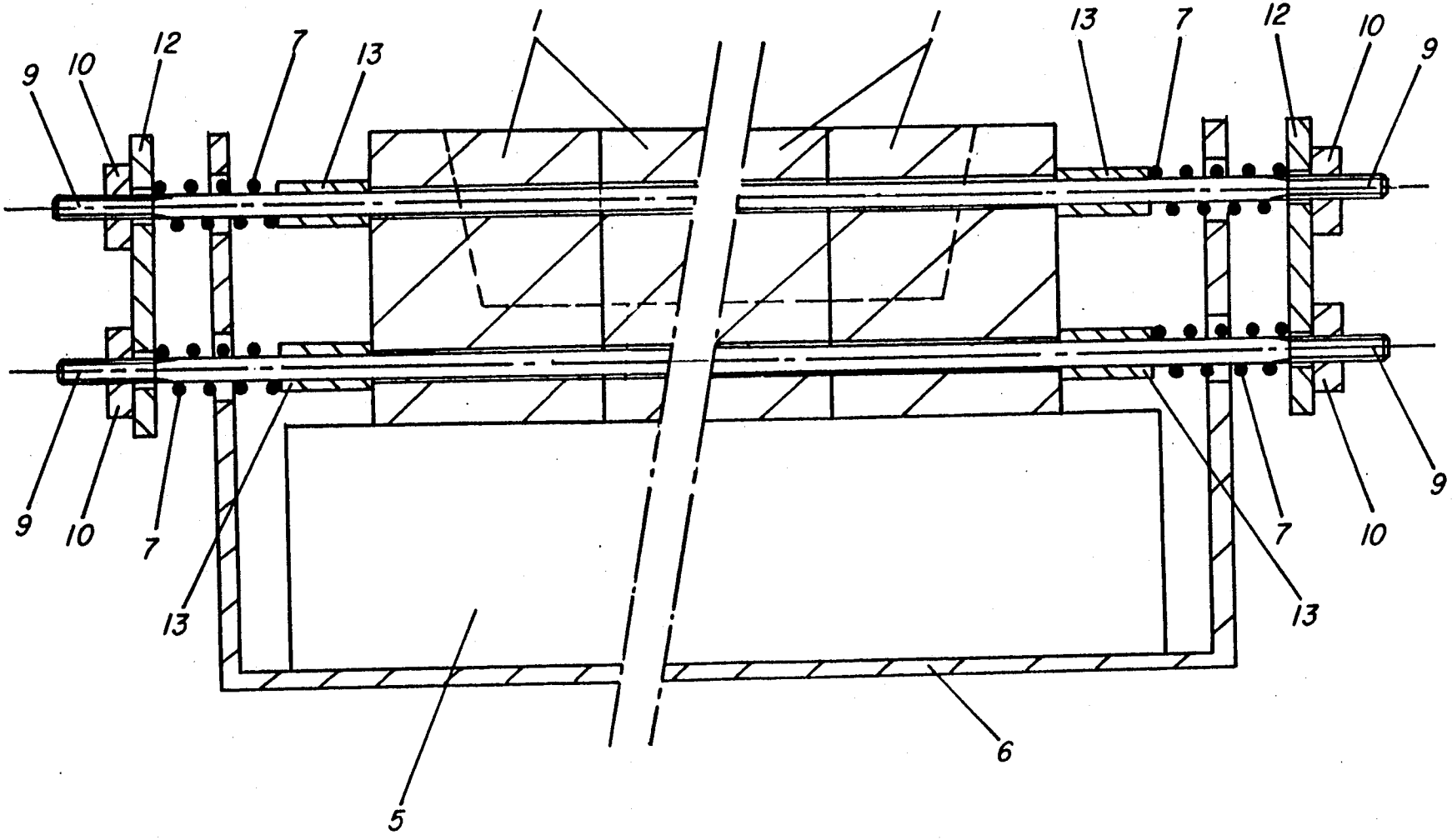
Fig. 3 D-D

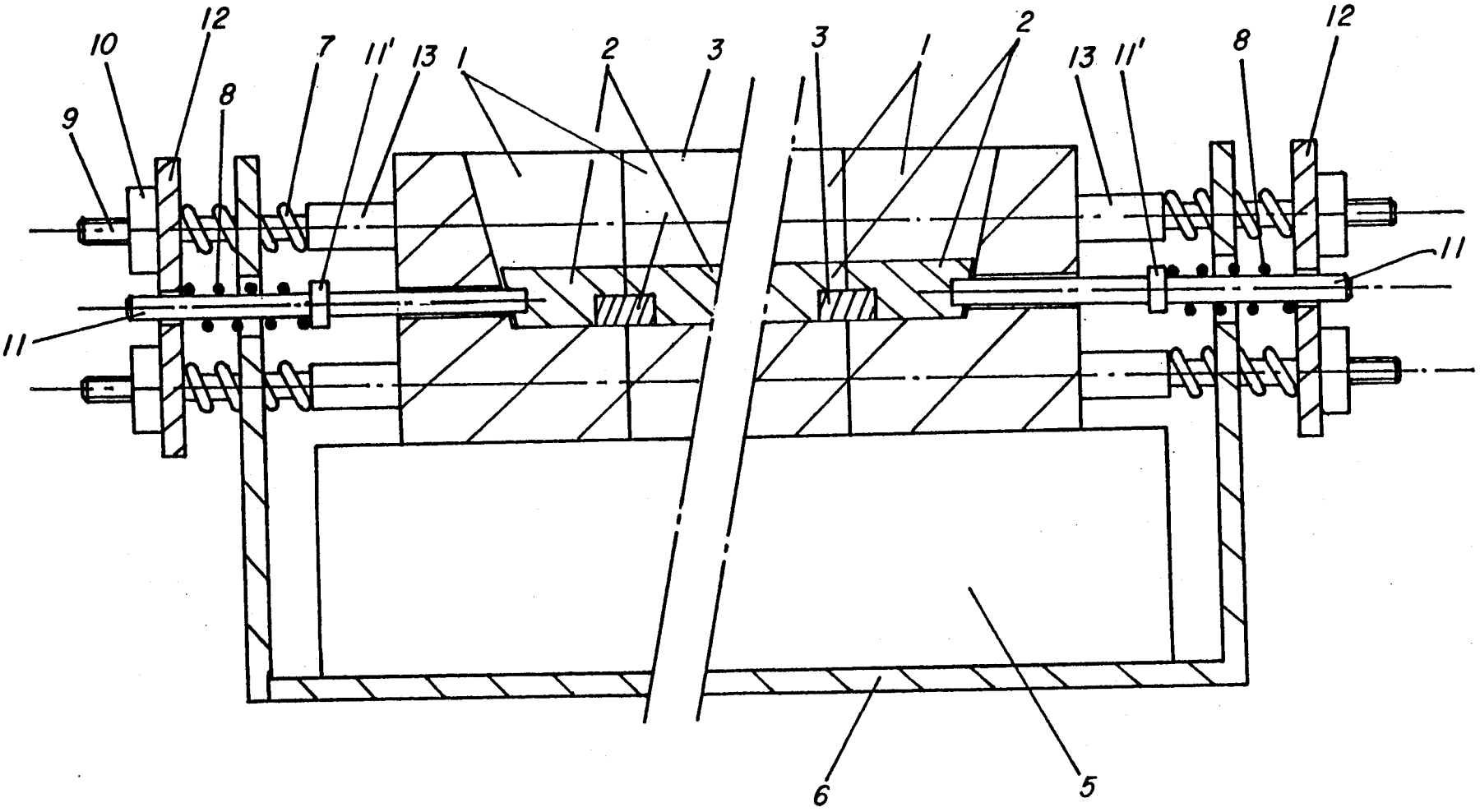
Fig. 4 E-E

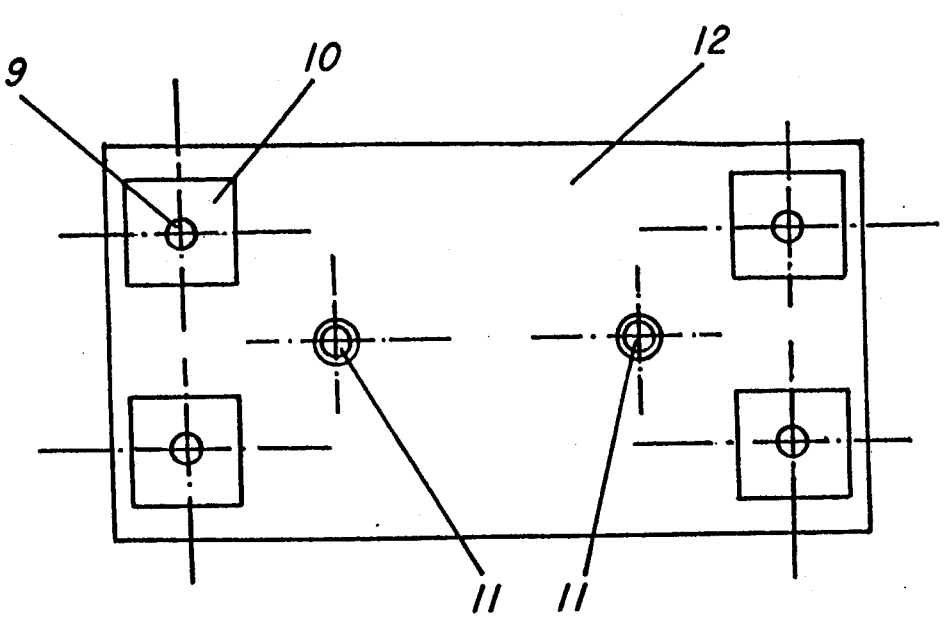
Fig. 5 C-C

ELECTROLYTIC FURNACE

The present invention relates to an electrolytic furnace, which is particularly intended for the production of aluminium.

The furnaces, and more especially the electrolytic furnaces, which are intended for the production of aluminium, are generally in the form of massive constructions, i.e. constructed in situ with solid materials, such as bricks and concrete. The refractory bricks form the solid base structure of the elements of the furnace. Such massive constructions are necessary, with the known furnaces, for supporting the considerable stresses which are caused by the expansion. The expansions create enormous forces, on account of the high temperatures of more than 900 degrees and make necessary considerable dimensions for the furnaces, which may measure more than 10 metres in length. Even with these enormous structures, it frequently happens that the expansion causes cracks in the elements of the furnace. The occurence of these cracks is uncontrollable and these may also occur after several days or even after several months from the time when the furnace is first brought into operation. These cracks make the installations unusable and the repairs generally necessitate a complete dismantling of the furnace. These dismantling operations are difficult, because the structures are made of solid materials which have to be demolished.

When repairs are necessary, the periods during which the installations are immobilised are long and are shown by corresponding losses of operation time. The electrolytic furnaces use an enormous amount of energy in order to function. So as to avoid needless loss of energy, it is important for the means used for insulation to be efficient.

The materials which are used for forming the structure of the tanks, for example, the refractory bricks, have insulation factors which are relatively low, and this is manifested by considerable losses of thermal energy.

Another important disadvantage of the existing installations is concerned with the efficiency of the electrical contacts between the carbon elements and the conductive metallic bars which supply the current. Openings corresponding to the exact dimensions of the bars are formed in the carbon elements, and the metallic bars are introduced thereinto. Deformations occur, because of considerable expansions of the furnace, and these modify the geometry of the surfaces which are in contact and as a consequence here and there the contact is no longer perfect, this being manifested by considerable losses of electrical energy.

It is the object of the invention to obviate the defects of the known installations.

To this end, the electrolytic furnace according to the invention is characterized in that it comprises a plurality of refractory concrete elements positioned on supports in such manner as to permit a sliding of the said concrete elements on the said supports, and carbon elements and conducting metallic bars, the refractory concrete elements, the carbon elements and the conducting bars being held fast by the action of compression-adjustable elastic members.

As the refractory concrete elements and the carbon elements are held together by elastic members, the result is that all the tensions caused by the expansion are absorbed by said members. The massive structures of the tanks are no longer necessary. The expansions being absorbed, the dangers of cracks are practically eliminated. If a material defect of the refractory concrete should, for example, have caused a crack, the repairs can be very easily carried out by simply replacing the single element involved.

The assembly of the refractory concrete elements, on the one hand, and the assembly of the carbon elements and conductive metallic bars, on the other hand, may be achieved by the action of separate resilient members.

The assembly of the refractory concrete elements may, for example, be effected with the aid of floating rods passing freely through the refractory concrete elements, an adjusting nut being mounted at one at least of the ends of each rod, the said end comprising a compression spring and a floating plate inserted between the end refractory concrete element and the nut, the assembly being so arranged that the spring is compressed between the plate and the end refractory concrete element by the tightening action of the nut. The assembling of the carbon elements and the conductive metallic bars is, for example, effected by means of push rods, each comprising a collar situated between the exterior carbon element and the floating plate, so as to maintain a spring in compression between the collar and the floating plate.

The assembly may be mounted inside a vat or tank, all the empty space between the refractory concrete elements and the structure of the tank being able to be filled with an insulation consisting of light synthetic material having a high insulation value, such as, for example, a flexible synthetic insulating foam, which considerably reduces the thermal losses. The structure of the supports may, for example, be simply formed of two rails.

According to one embodiment, the electrical contact surfaces between the carbon elements and the conducting metallic bars are held in contact by pressure, by the action of resilient compression members and by the weight effect of the carbon elements.

The furnace may comprise inert anodes or bipolar anodes. They may be chosen to be combustible or incombustible.

The surface of the carbon elements which is directed towards the interior of the tank may be covered with a wettable layer of aluminium.

Another important advantage consists in that the elastic or resilient members hold the carbon elements and the metallic bars by pressure, this guaranteeing a perfect electrical contact which is independent of expansions.

Using the principle according to the invention, it is possible to produce different elements by standardised prefabrication, this making possible a considerable reduction in the construction costs of the furnaces and a very rapid interchangeability of the elements.

The principle of the invention also permits of easy modification of existing traditional furnaces for the adaptation thereof in accordance with the characteristics of the invention.

Other advantages and favourable characteristics of the invention will become apparent from the following description of one example of a furnace according to the invention and by reference to the drawings, wherein :

FIG. 1 is a longitudinal section of the assembly of the cathode part of a furnace, shown diagrammatically, FIG. 2 is a transverse section on the line B—B of FIG. 1, FIG. 3 is a longitudinal section of the system for assembling the refractory concrete elements, FIG. 4 is a longitudinal section of the assembly system of the carbon elements, and FIG. 5 is a view of the floating plate, which holds the elastic members.

Referring to FIG. 1, refractory concrete elements 1 are disposed alongside one another on rails 5. The rails are mounted in a tank 6. The refractory concrete elements 1 are pressed one against the other by compression springs 7, which act in opposition against the external walls of the two refractory concrete elements 1, which are placed at each end of the furnace, and against floating plates 12. The floating plates are held laterally by nuts 10, which collaborate with rods 9 which extend right through the refractory concrete elements 1. Carbon elements 2 are positioned on the refractory concrete elements 1 and on the conductive metallic bars 3. The carbon elements 2 and the metallic bars 3 are pressed laterally one against the other by the pressure of springs 8, which act in opposition against the floating plates 12 and push rods 11. The push rods 11 act on the carbon elements. Insulating means 4 are placed between the tank 6 and the refractory concrete elements 1.

FIG. 2 shows a transverse section of the furnace. The rails 5 are placed in the tank 6. The insulating means 4 fill the empty spaces, between the concrete elements 1, the tank 6 and the rails 5. The metallic bars 3 traverse the furnace over its full width. Holes 9' are formed in the wall of the concrete elements 1 in order to permit the passage of the rods 9.

The system as regards assembly of the refractory concrete elements 1 is shown in detail in FIG. 3. Rods 9, which are threaded at the ends, extend freely through the refractory concrete elements 1 and the walls of the tank 6. Nuts 10 are mounted so as to collaborate with the screw-threads of the rods 9 and laterally hold the floating plates 12. Compression springs 7 are mounted loosely on the rods 9 between the floating plates 12 and sleeves 13 loosely mounted on the rods 9. The sleeves 13 bear against the external side walls of the refractory concrete elements 1. By tightening the nuts 10, these latter push the floating plates 12 towards the interior, thereby compressing the compression springs 7 against the refractory concrete elements 1 by means of the sleeves 13. The value of the assembly pressure of the refractory concrete elements 1 can be adjusted by displacement of the nuts 10, so as to compress the compression springs 7 to a greater or lesser extent. According to a modified embodiment, the compression springs 7 may be mounted externally of the plate 12, between the plate and the nuts 10.

The system as regards assembly of the carbon elements 2 and the conductive metallic bars 3 is shown in detail in FIG. 4. Push rods 11 are mounted for sliding movement in the lateral external walls of the refractory concrete elements and in the floating plates 12. The inside ends of the push rods 11 act against the lateral outside walls of the carbon elements 2. Compression springs 8 are placed between the floating plates 12 and the collars 11' of the push rods 11. The displacement towards the interior of the floating plates 12 under the screwing action of the nuts 10 compresses the springs 8, in the same manner as the springs 7. According to a modified embodiment, the push rods 11 are fitted with locking nuts mounted at their ends, the compression springs 8 then being disposed externally of the plate 12, between the plate and the nuts.

The assembly of the carbon elements 2 and the metallic bars 3 is obtained by the pressure of the push rods 11 against the lateral walls of the external carbon elements 2. This pressure holds the carbon elements 2 laterally against the metallic bars 3, and guarantees a perfect electrical contact. The contact pressure between the horizontal faces of the metallic bars 3 and the carbon elements 2 is obtained by the weight of the carbon elements 2, which are placed on the metallic bars 3.

FIG. 5 shows a view of a floating plate 12 and the transverse positioning of the rods 9, nuts 10 and push rods 11. Numerous modifications as regards construction of the furnace may be achieved. In particular, the refractory concrete elements may be disposed on any other supports than the rails, provided that these supports permit them to be displaced longitudinally and/or laterally by sliding (or in an equivalent manner, as for example rolling) The presence of a tank in which the supports are disposed is not essential, these latter may also be placed directly on the ground.

In a simplified constructional form, the rods 9 intended for the assembly of the refractory concrete elements may also be mounted externally of the said elements and not pass through them.

I claim:

1. Electrolytic furnace for the production of aluminium, comprising an electrolyte vat made of a plurality of refractory concrete elements forming the bottom and the side walls of the vat, said refractory concrete elements being placed on supports and being held integral by the action of first elastic compression member generating a compression force in a direction parallel with the longitudinal axis of the furnace, and carbon elements which constitute the cathode of the furnace and are in electric contact with conductive metallic bars which are parallel with the transversal direction of the furnace, said carbon elements being positioned inside said vat and placed on the inner surface of the bottom of the vat, the surfaces of mutual electrical contact of the said carbon elements with said metallic bars being held integral by the action of second elastic compression members, generating a compression force which is also directed in a direction parallel with the longitudinal axis of the furnace, as well as by the action of the weight of said carbon elements.

2. Furnace according to claim 1, wherein said refractory concrete elements are held integral by floating rods, parallel with the longitudinal axis of the furnace, and an adjusting nut being mounted at least at one of the ends of each rod, the said end comprising a compression spring and a floating plate inserted between the end refractory concrete element and the nut, the assembly being so arranged that the spring is compressed between the plate and the end refractory concrete element by the tightening action of the nut.

3. Furnace according to claim 1, wherein said carbon elements are assembled under the action of the pressure of push rods which are parallel with the longitudinal axis of the furnace and which comprise a collar situated between the exterior carbon element and the floating plate, so as to hold a spring in compression between the collar and the floating plate.

* * * * *